United States Patent [19]

Diez

[11] 4,082,162

[45] Apr. 4, 1978

[54] A-FRAME LADDER EXTENDER

[76] Inventor: Richard C. Diez, Rte. 2, Box 751, San Jose, Calif. 95131

[21] Appl. No.: 718,132

[22] Filed: Aug. 27, 1976

[51] Int. Cl.[2] ..... E06C 1/22; E06C 7/08

[52] U.S. Cl. ..... 182/166; 182/178; 182/228

[58] Field of Search ..... 182/194, 178, 228, 166, 182/207

[56] References Cited

U.S. PATENT DOCUMENTS

| | | | |
|---|---|---|---|
| 598,100 | 2/1898 | Kaganovsky | 182/184 |
| 1,013,515 | 1/1912 | Reed | 182/166 |
| 1,116,073 | 11/1914 | Anderson | 182/228 |
| 3,213,963 | 10/1965 | Vogt | 182/111 |

*Primary Examiner*—Reinaldo P. Machado

[57] ABSTRACT

The invention is concerned with a combination comprising an A-frame ladder which comprises a pair of main side rails having parallel steps disposed therebetween, a pair of rear side rails pivotally secured with a top end thereof adjacent a top end of the main side rails, a platform secured atop said main and rear side rails and means for fastening the rear side rails at a fixed angle from the main side rails. The combination further includes an attachment extending the length of the main side rails equally so that the ladder can be stably positioned on stairs or the like. The attachment comprises a pair of equal length extender rails along with means for attaching the extender rails, each adjacent a top end thereof, each adjacent a bottom end of a respective one of said main side rails to extend longitudinally therefrom. The attachment further includes telescoping step means below the bottom ends of the main side rails parallel to the steps and extending telescopically from a respective one to a respective other of the extender rails intermediate the bottom end of each of the main side rail and a bottom end of each respective one of the extender rails.

7 Claims, 5 Drawing Figures

A-FRAME LADDER EXTENDER

BACKGROUND OF THE INVENTION

Field of the Invention

The invention is concerned with means for extending equally the main side rails of an A-frame ladder so that the ladder can be placed stably upon stairs with the top platform of the ladder being generally horizontal.

Prior Art

The prior art teaches a number of means for extending one type of ladder or another. For example, U.S. Pat. No. 2,177,677 shows attachments for non-A-frame ladders to provide gripping to a surface via a star shaped shoe. U.S. Pat. No. 2,3076,797, shows an extension for a ladder which provides adjustment for uneven terrain. The adjustment includes a pair of members which are slidably detachable via bolts and wing nuts to the side bars of the ladder. U.S. Pat. No. 2,237,317 relates to an attachment supporting a ladder in a vertical position. U.S. Pat. No. 2,476,650 relates to an extension for each side of an A-frame ladder so that the A-frame ladder can be setup on uneven ground. U.S. Pat. No. 2,911,134 shows an attachment for the bottom of a ladder which provide adjustment for uneven ground. U.S. Pat. No. 2,936,849 shows an extension attachable to the bottom of a ladder which allows the ladder to be used on uneven ground. U.S. Pat. No. 3,861,500 show an extension for the bottom of a ladder. This extension makes use of pivotally mounted feet. U.S. Pat. No. 3,908,796 discloses yet another extension attachable to the bottom of a ladder and making use of pivotal feet. U.S. Pat. No. 3,937,298 shows yet another extension attachable to the bottom of a ladder and making use of pivotally attached feet.

The ladder extensions of the previously mentioned patents are generally designed for use with a straight ladder rather than with an A-frame ladder and are generally designed for making a ladder usable on uneven ground. U.S. Pat. No. 2,476,650 is the only patent specifically concerned with an A-frame ladder and even in this patent the emphasis is upon working on uneven ground whereby one side of the ladder is made longer than another side rather than making each main side rail of the step side of the ladder longer so that the ladder can be used on stairways.

While each of the above-discussed prior art patents is clearly concerned with means of extending ladders it should be pointed out that none of these references is concerned with providing an extension for an A-frame ladder whereby both side rails of the ladder are extended equally so that the ladder can be stably positioned upon stairs or the like. Further, none of the above-discussed patents is particularly concerned with an attachment for a ladder which includes positively acting telescopic means for changing the distance of separation of the side rails of the extension so that the extension can be used with ladders of different main side rail separation. Yet further, the above-discussed patents generally do not provide an additional step or steps as part of the extension device to allow easy access to the steps of the ladder itself when the steps of the ladder may be several feet above the ground as for example when the ladder is an A-frame ladder and is placed upon stairs with the platform thereof generally parallel to the ground. The present invention is concerned with an A-frame ladder-attachment combination which provides all of the above-mentioned advantages.

SUMMARY OF THE INVENTION

The invention is concerned with an A-frame ladder which comprises a pair of main side rails having parallel steps disposed therebetween, a pair of rear side rails pivotally secured with a top end thereof adjacent a top end of the main side rails, a platform secured atop said main and rear side rails and means for fastening said rear side rails at a fixed angle from said main side rails. More particularly the invention is concerned with such a ladder in combination with an attachment extending the length of the main side rails equally so that the ladder can be stably positioned on stairs or the like. The attachment comprises a pair of equal length extender rails along with means for attaching said extender rails, each adjacent a top end thereof, each adjacent a bottom end of a respective one of said main side rails to extend longitudinally therefrom. The attachment further includes telescoping step means below the bottom ends of said main side rails parallel to said steps and extending telescopically from a respective one to a respective other of said extender rails intermediate said bottom end of each of said main side rails and a bottom end of each respective one of said extender rails.

BRIEF DESCRIPTION OF THE DRAWINGS

The invention will be better understood by reference to the figures of the drawing wherein like numbers denote like parts throughout and wherein.

DETAILED DESCRIPTION OF THE PREFERRED EMBODIMENT

Figure 1:
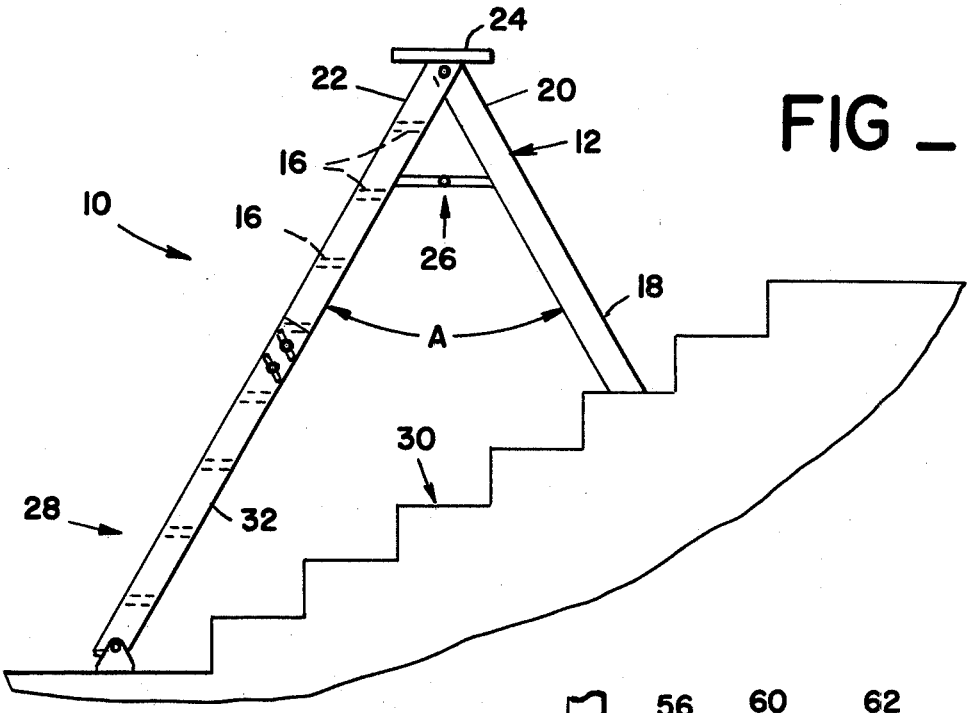
FIG. 1 illustrates a combination of the present invention in use on stairs.

The invention is concerned with a unique combination 10 including an A-frame ladder 12 which comprises a pair of main side rails 14 having a plurality of parallel steps 16 disposed therebetween. The ladder 12 also includes a pair of rear side rails 18 which are pivotally secured with a top end 20 thereof adjacent a top end 22 of the main side rails 14. A platform 24 is secured atop the main and rear side rails 14 and 18. Means are provided for fastening the rear side rails 18 at a fixed angle A to the main side rails 14. The means for fastening the rear side rails 18 at a fixed angle A from the main side rails 14 may for example comprise the illustrated locking hinge 26. The parts of the ladder 12 are conventional in nature and the ladder may be made of wood, aluminum or of any desired material.

Figure 2:
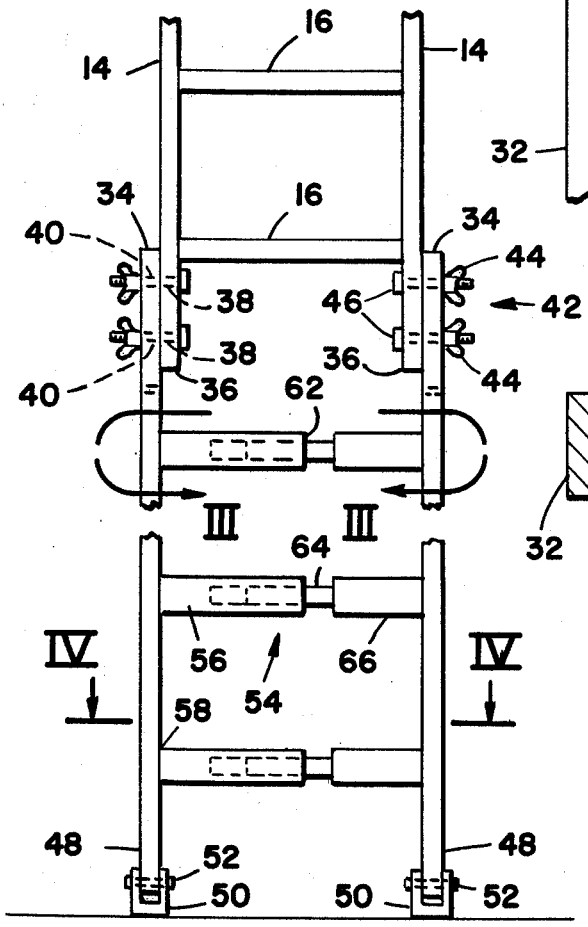
FIG. 2 illustrates part of a ladder and the attachment of the present invention extending therefrom in combination therewith.
Figure 3:
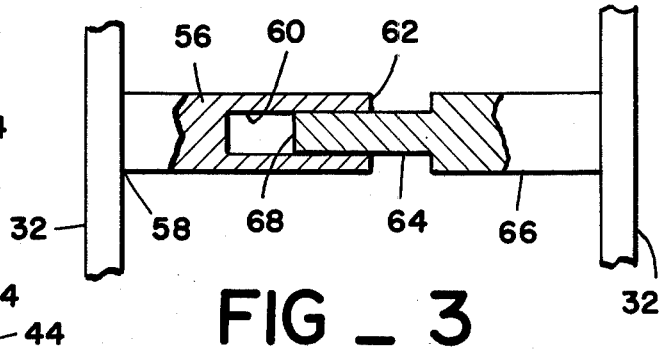
FIG. 3 illustrates a view in section taken in the area III—III of FIG. 2.
Figure 4:
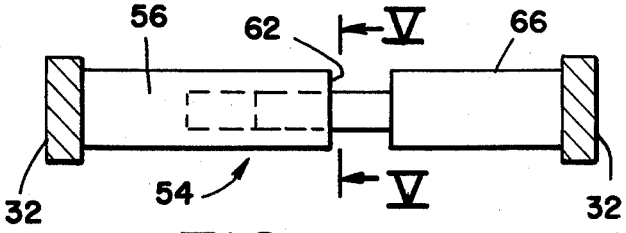
FIG. 4 illustrates a view taken along the line IV—IV of FIG. 2.
Figure 5:
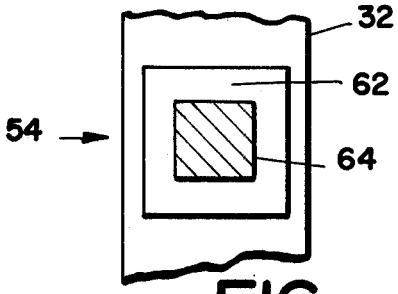
FIG. 5 illustrates a view taken along the line V—V of FIG. 4.

Generally, in use it is desirable that the platform 24 be generally level. When the platform 24 is level as for example when the ladder 12 is sitting upon a flat surface then the main side rails 14 and the rear side rails 18 hold the ladder in it's most stable position. However, it is often the case that a workman must have access via a ladder to an area relatively high above the ground adjacent a staircase. For example this might occur when one was painting the outside of a two-story house. In such an instance an attachment 28 as illustrated in FIGS. 1 and 2 is useful for extending the length of the main side rails 14 equally so that the ladder 12 can be stably positioned on for example the stairs 30. The attachment 28 of the present invention comprises a pair of equal length extender rails 32 which are parallel to one another. Means are provided for attaching the extender rails each adjacent a top end 34 thereof, each adjacent a bottom end 36 of a respective one of the main side rails 14. The extender rails 32 are attached adjacent to the bottom ends 36 of the main side rails 14 to extend longitudinally therefrom as illustrated very clearly in FIGS. 1 and 2.

The particular attaching means illustrated in the drawings include means for constraining the extender rails 32 to extend only longitudinally from the main side rails 14. This is accomplished by including adjacent to the bottom ends 36 of the main side rails 14 at least two holes 38 which extend latitudinally therethrough. The holes 38 are equally spaced from one another longitudinally along the main side rails 14. The top ends 34 of the extender rails 32 include a plurality of holes 40 said plurality preferably comprising at least three holes which pass latitudinally therethrough and are equally spaced to the holes 38 adjacent to the bottom ends 36 of the main side rails 14. The attaching means then preferably includes at least four bolt-nut means 42, two of the bolt-nut means 42 extending through aligned holes 38 in the bottom ends 36 of the main side rails 14 and holes 40 in the top ends 34 of the extender rails 32. Preferably, the bolt-nut means 42 includes butterfly nuts 44 along with bolts 46 whereby the bolt-nut means 42 can be quickly assembled to and disassembled from the ladder 12. It is preferred that there be at least three holes in the top end 34 of each of the extender rails 32 to allow the length of the attachment 28 to be varied somewhat as by using different adjacent pairs of the plurality of holes 40 in the top end 34 of the extender rails 32 for attachment to the pair of holes 38 in the bottom end 36 of the main side rails 14. Since the holes 38 and the holes 40 are longitudinally spaced along the main side rails 14 and the extender rails 32 respectively it is clear that the separation and use of at least two bolts in fastening each extender rail 32 to the respective main rail 14 constrains the extender rails 32 to extend only longitudinally from the main side rails 14.

The extender rails 32 preferably include at a respective bottom end 48 thereof a foot 50 pivotally mounted about an axis as defined by a pin 52 which is parallel to the steps 16. This is especially important when the combination 10 is used on steps since it assures a firm setting of the combination 10 in place.

A very important part of the present invention is provision of telescoping step means 54 below the bottom ends 36 of the main side rails 14. The telescoping step means 54 are parallel to the steps 16 and serve as an extension thereof. The telescoping step means 54 extend telescopically from a respective one to a respective other of the extender rails 32 intermediate the bottom ends 36 of each of the main side rails 14 and the bottom ends 48 of each respective one of the extender rails 32. In the embodiment of the invention as illustrated the telescoping step means 54 comprises a first rod 56 attached at a first end 58 thereof to a first of the extender rails 32. The first rod 36 has a cavity 60 which extends longitudinally thereinto from a second end 62 thereof. The telescoping means further comprises a second rod 64 which is attached at a first end 66 thereof to a second of the extender rails 32 at an equal distance from the top end 34 of the second of the extender rails 32 as the first end 58 of the first rod 56 is attached from the top end 34 of the first of the extender rails 32. A second end 68 of the second rod 64 is sized to matingly slidably fit within the cavity 60. That portion of the second rod 64 which is not sized to fit within the cavity 60 is generally of the same size as the first rod 56 to provide a generally even stepping surface for each of the telescoping step means 54. As will be apparent most particularly from reference to FIG. 2 the attachment 28 of the present invention prefereably includes a plurality of the first rods 56 and a corresponding plurality of the second rods 64 sequentially attached to the first and second of the extender rails 32, respectively. This is for the convenience of one climbing the telescoping step means 54 so as to bring the climbing person more easily up to the height of the steps 16. Further, it is preferred that the first rod 56 and the second rod 64 along with the cavity 60 be generally rectangular in cross-section. Making the first rod 56 and the second rod 64 rectangular in cross-section provides a flat stepping surface while making the cavity 60 rectangular along with the second end 68 of the second rod 64 assures a non-turning fit which adds stability to the telescoping step means 54 and to the attachment 28 generally.

While the invention has been described in connection with specific embodiments thereof, it will be understood that it is capable of further modification, and this application is intended to cover any variations, uses or adaptations of the invention following, in general, the principles of the invention and including such departures from the present disclosures as come within known or customary practice in the art to which the invention pertains and as may be applied to the essential features hereinbefore set forth, and as fall within the scope of the invention and the limits of the appended claims.

That which is claimed is:

1. In combination:

an A-frame ladder which comprises a pair of main side rails having a plurality of parallel steps disposed therebetween, a pair of rear side rails pivotally secured with a top end thereof adjacent a top end of said main side rails, a platform secured atop said main and rear side rails and means for fastening said rear side rails at a fixed angle from said main side rails; and an attachment extending the lengths of said main side rails equally so that said ladder can be stably positioned on stairs or the like, comprising:

a pair of parallel equal length extender rails;

means for attaching each extender rail, each adjacent a top end thereof, each adjacent a bottom end of a respective one of said main side rail to extend longitudinally therefrom; and telescoping means below the bottom ends of said main side rails parallel to said steps and extending telescopically from a respective one to a respective other of said extender rail intermediate said bottom end of each of said main side rails and a bottom end of each respective one of said extender rails, said telescoping step means comprising a first rod integrally attached at a first end thereof to a first of said extender rails, said first rod having a cavity extending longitudinally thereinto from a second end thereof and a second rod integrally attached to a first end thereof to a second of said extender rails at an equal distance from the top end of said second of said extender rails as said first end of said first rod is attached from the top end of said extender rails, a second end of said second rod being sized to matingly slidably fit within said cavity, said first and second rod and said cavity being rectangular in cross-section to provide a flat stepping surface and a non-turning fit of said second end of said second rod within said cavity.

2. An A-frame ladder-attachment combination as in claim 1, wherein said attaching means includes means for constraining said extender rails to extend only longitudinally from said main side rails.

3. An A-frame ladder-attachment combination as in claim 2, including at the bottom ends of each of said extender rails a foot pivotally mounted about an axis parallel to said steps.

4. An A-frame ladder-attachment combination as in claim 3, including a plurality of said first rods and a corresponding plurality of said second rods sequentially attached to said first and second of said extender rails, respectively.

5. An A-frame ladder-attachment combination as in claim 4, wherein said main side rails include at least two holes latitudinally therethrough adjacent said bottom ends thereof, said holes being equally spaced from one another longitudinally along said main side rails and said extender rails include adjacent said top ends thereof a plurality of at least three holes latitudinally therethrough of equal spacing as said main side rail holes and said attaching means includes at least four bolt-nut means, two of said bolt-nut means extending through aligned main side rail and extender rail holes in each respective main side rail and each respective corresponding extender rail.

6. An A-frame ladder-attachment combination as in claim 5, wherein said bolt-nut means includes butterfly nuts.

7. An A-frame ladder-attachment combination as in claim 1, wherein that portion of said second rod external of said cavity is of generally equal size with said first rod.

* * * * *